United States Patent [19]

Wiegand

[11] Patent Number: 4,865,220

[45] Date of Patent: Sep. 12, 1989

[54] DOUBLE WALL TANK FITTINGS

[75] Inventor: Joseph R. Wiegand, Bakersfield, Calif.

[73] Assignee: Owens-Corning Fiberglas Corporation, Toledo, Ohio

[21] Appl. No.: 214,350

[22] Filed: Jul. 1, 1988

[51] Int. Cl.[4] ..... B65D 90/08

[52] U.S. Cl. ..... 220/465

[58] Field of Search ..... 220/288, 465; 137/375, 137/590, 592

[56] References Cited

U.S. PATENT DOCUMENTS

| | | | |
|---|---|---|---|
| 1,053,452 | 2/1913 | Stover | 137/375 X |
| 1,231,548 | 6/1917 | Myers | 137/375 |
| 1,978,608 | 10/1934 | Straty | 220/465 X |
| 3,432,069 | 3/1969 | Craig | 220/465 X |
| 4,184,511 | 1/1980 | Wilson | 137/590 |
| 4,259,981 | 4/1981 | Busse | 137/375 |
| 4,653,663 | 3/1987 | Holtsclaw | 220/403 X |
| 4,700,868 | 10/1987 | Dirkin | 220/465 |
| 4,775,073 | 10/1988 | Webb | 220/465 X |

*Primary Examiner*—Stephen M. Hepperle

*Attorney, Agent, or Firm*—Patrick P. Pacella; Ted C. Gillespie; Charles R. Schaub

[57] ABSTRACT

A fitting for double wall underground storage tank where the tank has an inner wall and an outer wall is disclosed. A bore extends through the inner and outer walls of the tank. A substantially cylindrical connector having a passageway passing through the center of the connector is constructed to be positioned in the bore. A plurality of threads is positioned on the connector around the periphery of the passageway extending through the connector. A substantially cylindrical glass fiber reinforced plastic sleeve is positioned around the outer periphery of the connector. The sleeve matingly engages the outer periphery of the connector. The sleeve extends to encase the outer periphery of the connector that extends from the inner wall of the tank towards the outer wall of the tank. The connector and the sleeve are positioned in the bore with one end of the connector and sleeve extending from the outer wall of the tank. The connector and sleeve are secured to the inner and outer wall of the tank to secure the sleeve and connector to the tank.

29 Claims, 4 Drawing Sheets

DOUBLE WALL TANK FITTINGS

BACKGROUND OF THE INVENTION

This invention relates to a fitting that can be used with an underground glass fiber reinforced plastic storage tank. The fitting has a metal connector to which external plumbing connections can be made to allow fluid to be placed into or withdrawn from the underground storage tank. The metal fitting is substantially encased in glass fiber reinforced plastic so that the metal fitting is protected from the corrosive environment where underground storage tanks are normally located.

In past underground storage tanks metal pipes have been used to provide access to the interior of the tank. The metal pipe is positioned in a hole that passes through the inner and outer walls of the tank. The metal pipe is usually bonded to the walls of the tank to secure the pipe to the tank. In other applications the metal pipe pases through a reservoir which is formed on the exterior of the tank to contain leak detecting fluid. The metal pipe passes through an opening in the metal lid on the reservoir, extends through the reservoir and through the outer and inner walls of the tank to provide access to the interior of the tank. The metal pipe is secured to the inner wall of the tank and also welded or otherwise secured to the metal lid on the reservoir. In both applications the metal pipe extends above ground to provide access to the interior of the tank. In these applications the metal pipe is exposed to the corrosive environment in which the underground storage tank is positioned. This frequently results in leaks or corrosion damage to the metal pipe. In the tanks where a reservoir for leak detecting fluid is used leaks can occur at the joints between the metal lid of the reservoir and the metal pipe. Obviously, any type of leak can create a great deal of difficulty with an underground storage tank and limit the useful life of the tank. Underground storage tanks are made of glass fiber reinforced plastic to resist the corrosive environment of the ground where the tank is buried. By using metal piping and metal fittings to provide access to the interior of the tank, a serious corrosion problem still exists for the underground storage tanks.

Accordingly, it is desirable to have an improved fitting that provides access to a double wall underground storage tank that can effectively resist the corrosive environment where the tanks are located.

It is a further object of the invention to have a fitting to provide access to the interior of the tank that is encased in a non-corrosive glass fiber reinforced plastic material.

These other and other objects and advantages of the invention will be more readily understood by the following detailed description of the invention.

SUMMARY OF THE INVENTION

The invention is directed to a fitting for double wall underground storage tank where the tank has an inner wall and an outer wall. A bore extends through the inner and outer walls of the tank. A substantially cylindrical connector having a passageway passing through the center of the connector is constructed to be positioned in the bore. A plurality of threads is positioned on the connector around the periphery of the passageway extending through the connector. A substantially cylindrical glass fiber reinforced plastic sleeve is positioned around the outer periphery of the connector.

The sleeve matingly engages the outer periphery of the connector. The sleeve extends to encase the outer periphery of the connector that extends from the inner wall of the tank towards the outer wall of the tank. The connector and sleeve are positioned in the bore with one end of the connector and sleeve extending from the outer wall of the tank. The connector and sleeve are secured to the inner and outer wall of the tank to secure the sleeve and connector to the tank.

DESCRIPTION OF THE PREFERRED EMBODIMENT

Figure 1:
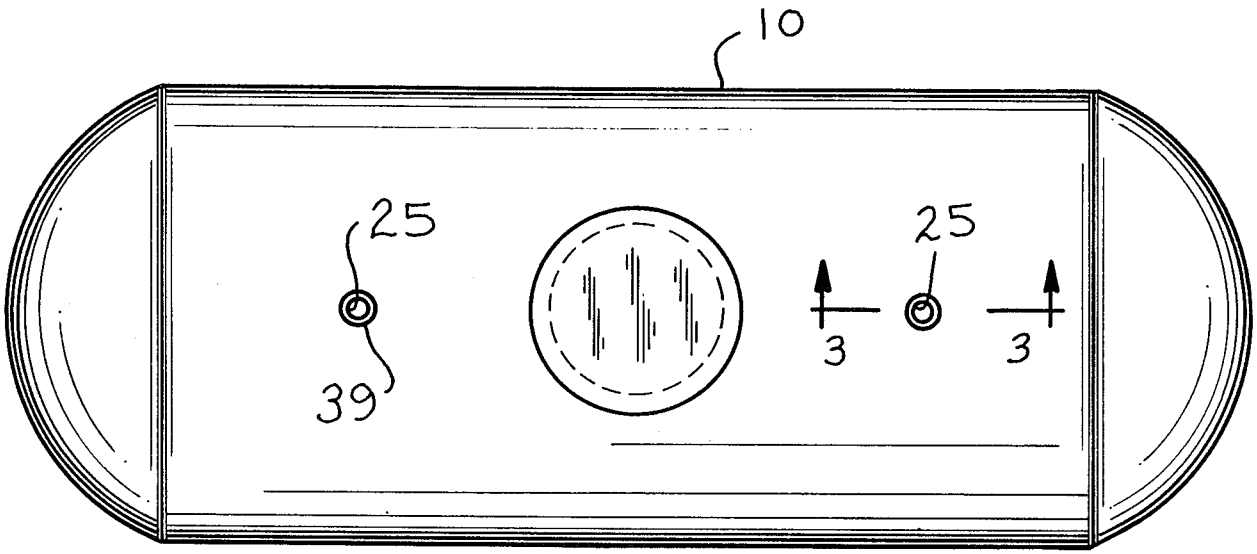
FIG. 1 is a plan view of a double wall underground storage tank.

The invention relates to a fitting that can be used with a double wall glass fiber reinforced plastic underground storage tank to provide access to the interior of the tank. More particularly, the invention relates to a fitting having a glass fiber reinforced plastic sleeve positioned around the exterior of the fitting to provide a non-corrosive cover for the metal components of the fitting. A glass fiber reinforced plastic underground storage tank 10 is provided and the tank has an inner wall 11 and an outer wall 13. An annular space 17 is provided between the inner wall 11 and the outer wall 13 of the tank 10. Reinforcing ribs 19 can be provided in the annular space 17 in a manner well-known in the art to provide reinforcing for the wall of the tank and also to assist in maintaining the proper spacing for the walls of the tank 10.

A bore 21 extends through the inner wall 11 and outer wall 13 of the tank 10. The bore usually has a substantially circular cross-sectional shape and provides a path of communication from the exterior or the tank to the interior reservoir that is designed to hold a fluid. A metal connector 23 having a substantially cylindrical shape is provided for positioning in the bore 21. The metal connector has a passageway 25 that extends through the center of the connector. A metal plate 27 is secured to the outer periphery adjacent to one end of the metal connector 23. The plate 27 extends from the outer periphery of the metal collector in a direction that is substantially perpendicular to the center line or longitudinal axis of the passageway 25 passing through the connector 23. The plate is disposed to engage the inner surface of the inner wall 11. The plate 27 is normaly slightly curved so that the plate 27 has substantially the same curvature as and is in direct contact with a portion of the inner surface of the inner wall 11 adjacent the bore 21. A small section 29 of the connector 23 extends below the plate 27 and into the interior of the tank 10.

A plurality of threads 31 are positioned around the outer periphery of the metal connector 23. The threads 31 extend from substantially the plate 27 along the connector to the end of the connector that is spaced apart from the plate 27. A plurality of connector threads 35 are positioned on the connector around the periphery of the passageway extending through the connector 23. The connector threads 35 extend from the end of the connector 23 that is spaced apart from the plate 27 in a direction towards the plate 27 and the interior of the tank 10. The connector threads 35 must extend along the passageway 25 for a distance sufficient to allow external piping or plumbing connections to be made with the metal connector 23.

A substantially cylindrical glass fiber reinforced plastic sleeve 39 is positioned around the outer periphery of the metal connector 23. The interior surface of the sleeve 39 has a plurality of threads 41 on the interior of the sleeve. The threads 41 are disposed to matingly engage the threads 31 on the exterior of the connector 23. The sleeve 39 is constructed to extend from the plate 27 to the end of the metal connector 23 that is spaced apart from the plate. Thus, the sleeve 39 totally encases the outer periphery of the connector 23 that extends from the interior of the tank 10. The outer periphery of the sleeve 39 is sized so that it engages or is adjacent to the bore 21 that passages through the inner wall 11 and outer wall 13. A resinous material can be applied to the threads 31 on the connector 23 prior to the positioning of the sleeve 39 on the connector. The resinous material bonds the sleeves to the connector and assists in forming a fluid-tight seal between the connector and the sleeve. An epoxy-type material is particularly well-suited for use as a resinous material. The connector 23 and sleeve 39 form a fitting that can be positioned on the tank 10.

To install the fitting, the glass fiber reinforced plastic sleeve 39 is positioned around the exterior of the metal connector 23 with the threads 41 on the sleeve engaging the threads 31 on the connector. The connector and sleeve are then inserted into the bore 21 in the inner wall 11 and outer wall 13. The sleeve and connector are inserted from the interior of the tank into the bore 21 so that the plate 27 is brought into engagement with the inner surface of the inner wall 11 of the tank 10. A layer 45 glass fiber reinforced plastic is positioned over the plate 27 and onto the inner surface of the inner wall 11 to integrally bond the plate, connector 23 and sleeve 39 to the inner wall of the tank 10. The layer 45 of glass fiber reinforced plastic abuts the section 29 of the connector 23 that extends into the interior of the tank 10.

A bead 49 of glass fiber reinforced plastic is positioned on the sleeve 39 and the outer surface of the outer wall 13 to integrally bond the sleeve and metal connector 23 to the outer wall 13. The layer 45 and bead 49 of glass fiber reinforced plastic are normally applied by the hand layup method.

After the metal connector 23 and the sleeve 39 are in position, the connector threads 35 can then receive a pipe or other pumping-type connections that can lead above ground for either filling or removing fluid from the tank 10. Because of the sleeve 39 the metal connector 23 that extends from the tank 10 is protected from the corrosive environment normally encountered in underground storage tanks. It should be recognized, that even the small section 51 of the metal connector 23 at the end of the connector that is located at the end of the sleeve 39 can be covered with a layer of resin or glass fiber reinforced plastic once the piping or plumbing connections have been made to the metal connector. It is also significant that the portion of the metal connector 23 that is located between the inner wall 11 and the outer wall 13 of the tank 10 is also totally surrounded by the glass fiber reinforced plastic sleeve 39. Since a leak detecting fluid is frequently positioned in the annular space 17 between the inner wall 11 and outer wall 13 to monitor any leakage from the tank 10, the sleeve further protects this portion of the metal connector 23. As can be seen from the above description, the fitting that is formed by the metal connector 23 and the sleeve 39 provides a very strong fitting that can be used to connect external pipe or plumbing to the underground storage tank 10. The metal connector threads 35 are also very strong and provide an excellent base for plumbing connections to the tank 10. At the same time this fitting is almost totally encased in noncorrosive glass fiber reinforced plastic material to substantially eliminate corrosion related leakage problems that occur due to the corrosive environment in which most underground storage tanks are located. The glass fiber reinforced plastic sleeve 39 also provides protection for the fitting from any corrosive influences that might be present from a leak detecting fluid that is positioned in the annular space 17 between the inner wall 11 and outer wall 13 of the tank 10. The fittings can also be positioned wherever desired on the tank 10. There is no need to position several fittings or plumbing connections at one location because that is the only location where a reservoir is located that can accept the fittings.

Figure 4:
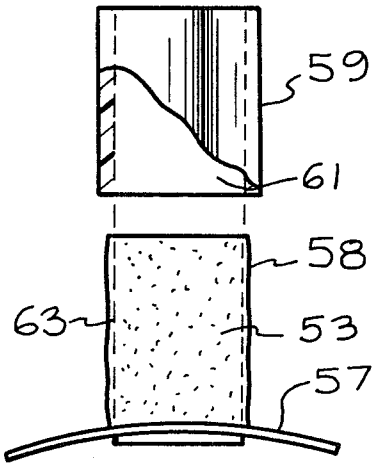
FIG. 4 is a partially broken away fragmentary view of another embodiment of a fitting of the present invention.
Figure 5:
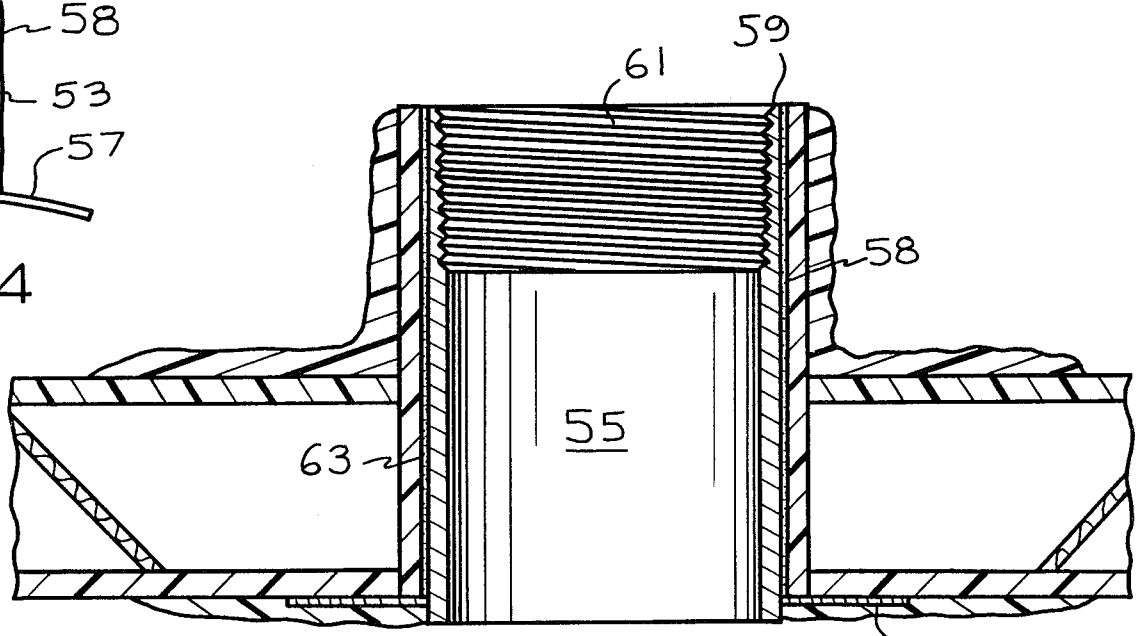
FIG. 5 is a cross-sectional view of the fitting of FIG. 4.

FIGS. 4 and 5 show another embodiment of the present invention with a different method of bonding the sleeve to the connector.

A metal connector 53 having a substantially cylindrical shape is provided for positioning in the bore 21 of the tank 10. The connector 53 is substantially the same as the previously described connector 23. A metal plate 57 is secured to the outer periphery of the connector 53 as previously described. However, the connector 53 has an outer periphery that has a roughened surface 58 instead of the plurality of threads as shown on the connector 23. The roughened surface can be produced by sandblasting, sanding or other suitable methods that produce a roughened surface. The roughened surface extends from the plate 27 to the opposite end of the connector 23.

A substantially cylindrical glass fiber reinforced plastic sleeve 59 is positioned around the outer periphery of the metal connector 53. The interior surface of the sleeve 59 has a roughened surface 61 that is disposed to engage the roughened surface 58 on the metal connector 53. The roughened surface 61 on the sleeve 59 can be produced by sanding, cutting partial threads on the interior of the sleeve or other suitable methods that produce a roughened surface. The sleeve 59 is sized so that it will fit around the connector 53 with a hand press fit with no noticeable gaps between the connector 53 and the sleeve 59. A layer 63 of resinous material is positioned on the roughened surface 58 of the connector 53 prior to the positioning of the sleeve 59 on the connector. The layer 63 of resinous material bonds the sleeve to the connector and assists in forming a fluid-tight seal between the connector and the sleeve. An epoxy-type resinous material is particularly well-suited for bonding the sleeve 59 to the connector 53. The connector 53 and the sleeve 59 form a fitting that can be positioned on the tank 10 as previously described. The embodiment shown in FIGS. 4 and 5 eliminates the need to cut the threads on the connector and the sleeve and significantly reduced the cost for the fitting.

Figure 3:
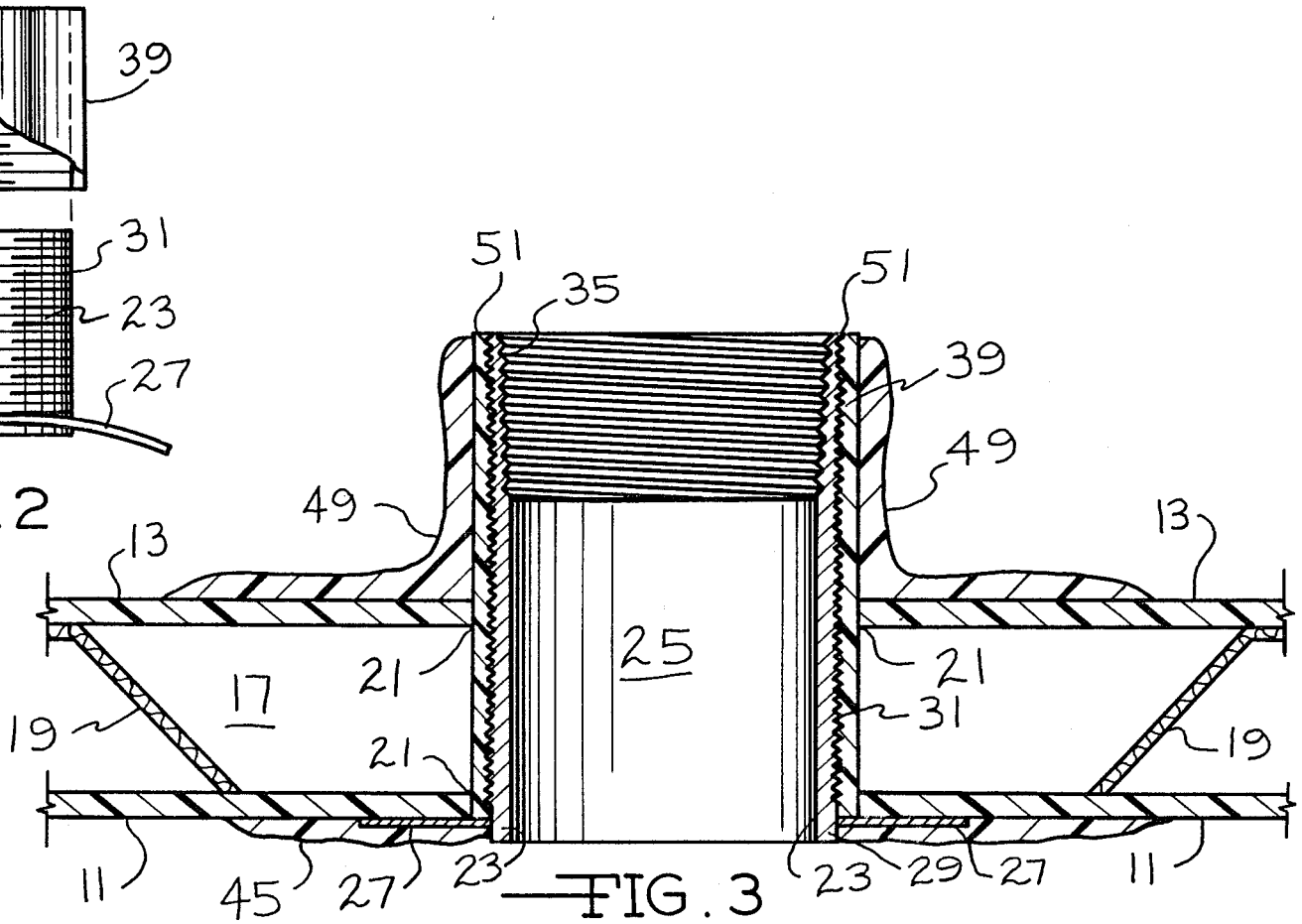
FIG. 3 is a cross-sectional view taken along line 3—3 of FIG. 1.
Figure 2:
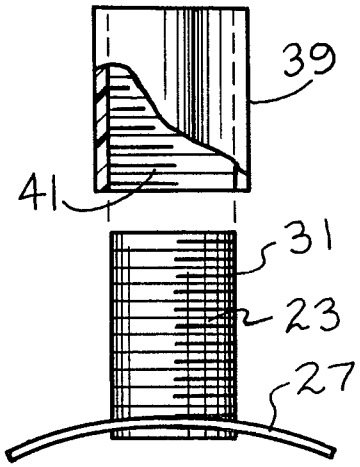
FIG. 2 is a partially broken away fragmentary view of a fitting of the present invention.
Figure 6:
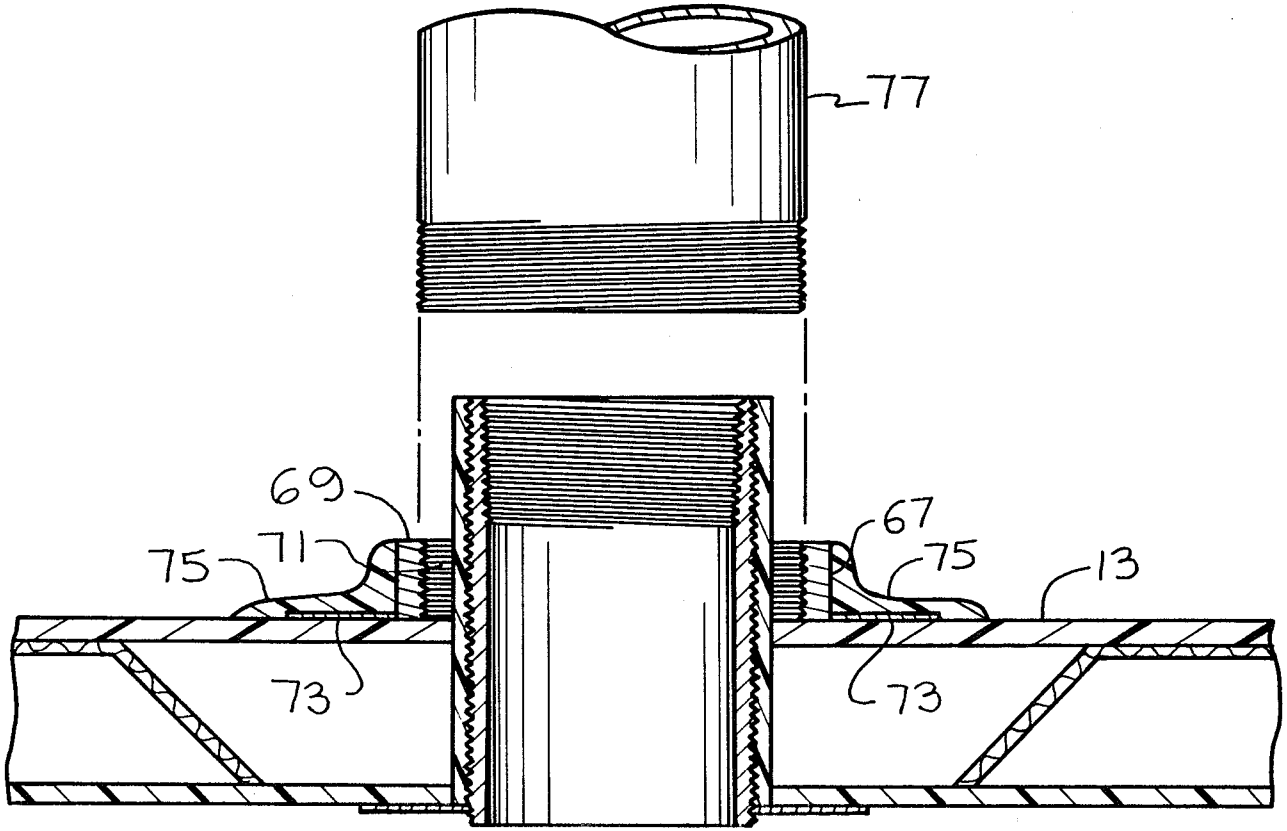
FIG. 6 is a cross-sectional view of another embodiment of the invention.

FIG. 6 shows another embodiment of the fitting that can be used with a double wall tank 10. A connector and sleeve are positioned in the bore 21 of a double wall tank 10 as previously described. The connector and sleeve can be of the type shown in FIGS. 1–3 or the type shown in FIGS. 4–5. Once the connector and sleeve are in position a secondary containment coupling 67 is positioned concentrically around the glass fiber reinforced plastic sleeve. The secondary containment coupling 67 has an opening 69 in the center that is large enough to receive the connector and sleeve of the fitting that passes through the walls of the tank. A plurality of threads 71 are positioned on the inner periphery of the opening 69. The secondary containment coupling can be made of metal or glass fiber reinforced plastic. A flange 73 can be secured to the secondary containment coupling in a manner so that the flange extends along the outer wall 13 of the tank. The flange 73 can be curved to conform to the curvature of the outer wall of the tank. The secondary containment coupling 67 is secured to the outer wall 13 of the tank by a layer 75 of glass fiber reinforced plastic. The layer 75 of glass fiber reinforced plastic extends along the outer periphery of the secondary containment coupling 67 and onto the outer wall 13 of the tank. If the secondary containment coupling utilizes a flange 73 the layer 75 also extends over the flange 73. In this manner, the secondary containment coupling is securely attached to the outer wall 13 of the tank. The layer 75 of glass fiber reinforced plastic essentially encloses the outer periphery of the secondary containment coupling 67. This significantly reduces any corrosion problems that could occur, especially when the secondary containment coupling is made of metal.

Once the secondary containment coupling 67 is in position, a pipe 77 can be threaded into the threads 71 to enclose the connector and sleeve of the fitting that passes through the walls of the double wall tank 10. The pipe 77 normally leads above ground and provides a containment structure around the fitting and any plumbing connections that are made to the fitting. At the same time an annular space is created around the fitting and the space can be monitored to determine if there are any leaks in the fitting or the plumbing that is connected to the fitting. Accordingly, the secondary containment coupling provides an additional safety feature that can provide secondary containment and leak monitoring for the fitting at a very reasonable cost.

The above detailed description of the invention is give for the sake of explanation. Various modifications and substitutions, other than those cited, can be made without departing from the scope of the invention as defined by the following claims.

I claim:

1. A fitting for a double wall underground storage tank, said tank having an inner and an outer wall, said fitting comprising:

a bore extending through said inner and outer walls of said tank;

a connector having a passageway passing through said center of said connector, said connector being constructed to be positioned in said bore;

a plurality of connector threads positioned on said connector around said periphery of said passageway extending through said connector; and a plastic sleeve positioned around said outer periphery of said connector, said sleeve engaging said outer periphery of said connector, said sleeve extending to encase said outer periphery of said connector that extends from said inner wall of said tank towards said outer wall of said tank, said connector and said sleeve positioned in said bore with one end of said connector and sleeve extending from said outer wall of said tank, said connector and sleeve being secured to said inner and outer walls of said tank to secure said sleeve and connector to said tank.

2. The fitting of claim 1, wherein said connector has an exterior surface and said exterior surface of said connector is coated with a resinous material whereby said resinous material bonds said sleeve to said connector and assists in forming a fluid tight seal between said connector and said sleeve.

3. The fitting of claim 1, wherein said connector is secured to said inner wall of said tank and said sleeve is secured to said outer wall of said tank.

4. The fitting of claim 1, wherein a plate is secured to said outer periphery of said connector at one end of said connector, said plate extending from said connector in a direction that is substantially perpendicular to said longitudinal axis of said connector, said plate being disposed to engage said inner surface of said inner wall of said tank, with said plate being secured to said inner wall to secure said connector to said tank, said connector and sleeve being positioned in said bore so that said plate engages said inner wall of said tank.

5. The fitting of claim 4, wherein said plate is shaped to conform to the contour of said inner surface of said inner wall whereby said plate is in engagement with said inner surface of said inner wall when said connector and sleeve are properly positioned on said tank.

6. The fitting of claim 5, wherein said plate is secured to said inner wall by a layer of hand laid up glass fiber reinforced plastic to integrally bond said plate, said connector and said sleeve to said inner wall, said layer of glass fiber reinforced plastic completely covering said plate.

7. The fitting of claim 1, wherein a bead of glass fiber reinforced plastic is positioned on said outer surface of said outer wall and on said sleeve to integrally bond said sleeve and said connector to said outer wall.

8. The fitting of claim 2, wherein said outer periphery of said connector and said interior of said sleeve are provided with a roughened surface to improve said resinous bond between said connector and said sleeve.

9. The fitting of claim 1, wherein a plurality of threads are positioned around said outer periphery of said connector and a plurality of threads are positioned on the interior of said sleeve for matingly engaging said threads on said outer periphery of said connector to secure said sleeve to said connector.

10. The fitting of claim 1 wherein a coupling is positioned concentrically around said sleeve, said coupling being secured to said outer wall of said tank.

11. The fitting of claim 10 wherein a plurality of threads are positioned around said inner periphery of said coupling.

12. The fitting of claim 11 wherein a flange is positioned on one end of said coupling, said flange being disposed for engaging said outer wall of said tank.

13. The fitting of claim 12 wherein a layer of glass fiber reinforced plastic is positioned on said coupling and said outer wall of said tank to secure said coupling to said tank.

14. The fitting of claim 11 wherein a pipe threadingly engages said threads of said coupling, said pipe and coupling forming a containment structure around said fitting to confine any leakage from said fitting.

15. The fitting of claim 14 wherein said pipe and coupling form an annular space around said fitting, said annular space being subject to monitoring to determine if there is any leakage from said fitting or plumbing connected to said fitting.

16. A fitting for a double wall underground storage tank, said tank having an inner and an outer wall, said fitting comprising:

a bore extending through said inner and outer walls of said tank;

a substantially cylindrical metal connector having a passageway passing through said center of said connector and an outer periphery, said connector being constructed to be positioned in said bore;

a plurality of threads positioned around said outer periphery of said connector and a plurality of connector threads positioned on said connector around said periphery of said passageway extending through said connector; and a substantially cylindrical glass fiber reinforced plastic sleeve positioned around said outer periphery of said connector, said sleeve having threads on the interior for matingly engaging the threads on said outer periphery of said connector, said sleeve extending to encase said outer periphery of said connector that extends from said inner wall of said tank towards said outer wall of said tank, said connector and said sleeve positioned in said bore with one end of said connector and sleeve extending from said outer wall of said tank, said connector and sleeve being secured to said inner and outer walls of said tank to secure said sleeve and connector to said tank.

17. The fitting of claim 16, wherein said threads on the exterior surface of said connector are coated with a resinous material whereby said resinous material bonds said sleeve to said connector and assists in forming a fluid tight seal between said connector and said sleeve.

18. The fitting of claim 16, wherein said connector is secured to said inner wall of said tank and said sleeve is secured to said outer wall of said tank.

19. The fitting of claim 16, wherein a plate is secured to said outer periphery of said connector at one end of said connector, said plate extending from said connector in a direction that is substantially perpendicular to said longitudinal axis of said connector, said plate being disposed to engage said inner surface of said inner wall of said tank, with said plate being secured to said inner wall to secure said connector to said tank, said connector and sleeve being positioned in said bore so that said plate engages said inner wall of said tank.

20. The fitting of claim 19, wherein said plate is shaped to conform to the contour of said inner surface of said inner wall whereby said plate is in engagement with said inner surface of said inner wall when said connector and sleeve are properly positioned on said tank.

21. The fitting of claim 20, wherein said plate is secured to said inner wall by a layer of hand laid up glass fiber reinforced plastic to integrally bond said plate, said connector and said sleeve to said inner wall.

22. The fitting of claim 21, wherein said layer of glass fiber reinforced plastic completely covers said plate.

23. The fitting of claim 16, wherein a bead of glass fiber reinforced plastic is positioned on said outer surface of said outer wall and on said sleeve to integrally bond said sleeve and said connector to said outer wall.

24. The fitting of claim 16, wherein said threads on said outer periphery of said connector extend from said plate to said end of said connector that extends from said tank.

25. The fitting of claim 16, wherein said threads positioned in said connector around said periphery of said opening extend from said end of said connector that extends from said tank in a direction towards said tank, said threads in said opening being disposed to receive piping connections for said tank.

26. A fitting for a double wall underground storage tank, said tank having an inner and an outer wall, said fitting comprising:

a bore extending through said inner and outer walls of said tank;

a substantially cylindrical metal connector having a passageway passing through said center of said connector, said connector being constructed to be positioned in said bore, said exterior surface of said connector being rough;

a plurality of connector threads positioned on said connector around said periphery of said passageway extending through said connector;

a plate secured to said outer periphery of said connector at one end of said connector, said plate extending from said connector in a direction that is substantially perpendicular to said longitudinal axis of said connector, said plate being disposed to engage said inner surface of said inner wall of said tank with said plate being secured to said inner wall to secure said connector to said tank;

a substantially cylindrical glass fiber reinforced plastic sleeve positioned around said outer periphery of said connector, said interior surface of said sleeve having a rough surface for matingly engaging rough surface on said outer periphery of said connector, said sleeve extending from said plate to said opposite end of said connector to encase said outer periphery of said connector that extends from said inner wall of said tank towards said outer wall of said tank, said connector and said sleeve positioned in said bore so that said plate engages said inner wall of said tank and the opposite end of said connector and sleeve extends from said outer wall of said tank, said sleeve being secured to said outer wall of said tank to secure said sleeve and connector to said tank; and a coating of resinous material applied to said exterior surface of said connector, said resinous material bonding said sleeve to said connector and assisting in forming a fluid-tight seal between said sleeve and said connector.

27. The fitting of claim 26, wherein said plate is shaped to conform to the contour of said inner surface of said inner wall whereby said plate is in engagement with said inner surface of said inner wall when said connector is properly positioned on said tank.

28. The fitting of claim 27, wherein said plate is secured to said inner wall by a layer of hand laid up glass fiber reinforced plastic to integrally bond said plate and said connector to said inner wall.

29. The fitting of claim 26, wherein a bead of glass fiber reinforced plastic is positioned on said outer surface of said outer wall and on said sleeve to integrally bond said sleeve and said connector to said outer wall.

* * * * *